United States Patent [19]

Ritchie

[11] Patent Number: 4,763,444

[45] Date of Patent: Aug. 16, 1988

[54] VIEWING AND ORAL COMMUNICATIONS ASSEMBLY FOR DOORS

[76] Inventor: Ruben R. Ritchie, Tregenna, Kingston Hill, Surrey KT2 7LK, United Kingdom

[21] Appl. No.: 68,258

[22] Filed: Jun. 30, 1987

[51] Int. Cl.[4] ..... E06B 7/28

[52] U.S. Cl. ..... 49/171; 350/319; 350/587; 350/601; 350/612

[58] Field of Search ..... 49/171; 350/506, 587, 350/601, 612, 319, 514–577

[56] References Cited

U.S. PATENT DOCUMENTS

| | | | |
|---|---|---|---|
| 141,476 | 8/1873 | Voss et al. | 350/616 |
| 425,500 | 4/1890 | Evans | 350/616 |
| 584,078 | 6/1897 | Jensen | 350/616 |
| 1,799,164 | 4/1931 | Griswold . | |
| 1,901,303 | 3/1933 | Keil . | |
| 2,096,740 | 10/1937 | Frankel | 49/171 X |
| 2,624,922 | 1/1953 | Ackerman | 49/171 X |
| 3,203,052 | 8/1965 | Curtis, Jr. | 49/171 X |
| 3,973,835 | 8/1976 | Miyakawa et al. | 350/319 |
| 4,050,792 | 9/1977 | Svensson | 350/319 |
| 4,116,529 | 9/1978 | Yamaguchi | 350/69 |
| 4,251,127 | 2/1981 | Yamaguchi | 350/69 |
| 4,571,901 | 2/1986 | Morris et al. | 52/106 |

OTHER PUBLICATIONS

"With Safety in View", *Womans Weekly,* Aug. 1987.

*Primary Examiner*—Philip C. Kannan
*Attorney, Agent, or Firm*—Kilpatrick & Cody

[57] ABSTRACT

A viewing and oral communications assembly for doors generally rectangular in shape, having mirror surfaces to transmit images from positions adjacent to the door through the assembly and having audio communication slots which are closed by expansion of intumescent material in the presence of heat.

14 Claims, 3 Drawing Sheets

VIEWING AND ORAL COMMUNICATIONS ASSEMBLY FOR DOORS

BACKGROUND OF THE INVENTION

The present invention relates to devices for looking and speaking through a door without opening the door.

A desire has probably existed for as long as there have been doors for a means of identifying and communicating with a caller outside the door without opening it. Numerous devices have long been used for this purpose, including various small hinged or sliding doors mounted on the passage door selectively to obstruct or clear a small opening through the door. Such devices are normally positioned at approximately adult-eye level. Other widely used devices include "fish-eye" lens devices mounted in holes in the door, also at eye level, but such devices do not facilitate oral communication through the door.

Conventional peephole devices typically permit viewing of an area generally opposite the peephole but make it difficult or impossible to see areas close to the door and not directly in front of the peep hole, thereby enabling someone to crouch below or to one side of the peephole against the door or building out of sight of a person looking through the peephole. Furthermore, while such conventional openings permit oral communication through the door, they also typically transmit smoke and heat from a fire and permit transmission of harmful materials by a would-be intruder. "Fish-eye" lens devices provide a wider viewing angle through the door but significantly distort the image and do not provide for oral communication through the door. Conventional "fish-eye" lens devices also frequently transmit heat from one side of the door to the other and may thus reduce the fire rating of a door in which they are mounted.

This is an important concern because many doors on which the use of viewing devices is desirable must be fire rated. Accordingly, use of a viewing device in such doors which reduces the fire rating is not acceptable.

Typical prior art devices for identifying a caller on the other side of a door include the "Attachment For Doors" described in U.S. Pat. No. 1,901,303 to H. F. Keil, the "Door For Panels" described in U.S. Pat. No. 1,799,164 to S. E. Griswold, the "Vandal Resistant Security View Port" described in U.S. Pat. No. 4,571,901 to Morris and Hafner, the "Wide-Angle Spy Glass" described in U.S. Pat. No. 4,116,529 to Yamaguchi and the "Wide Angle Door Viewer" described in U.S. Pat. No. 4,251,127 to Yamaguchi.

SUMMARY OF THE INVENTION

The present invention provides a versatile and attractive viewing and oral communications assembly for doors which is positioned in and framing a generally rectangular opening through the door. The present invention is intended for typical location at adult-eye level, approximately five (5) feet above floor level through the horizontal center line of the device. Interior and exterior frame assemblies hold a rectangular piece of high-temperature glass in place in a frame formed of non-combustible fiber board, such as "Monolux 500" available from Cape Boards and Panels, Ltd., Iver Lane, Uxbridge UB8 2JQ, England. Slots adjacent to portions of the glass edge permit transmission of sound through the viewing assembly to facilitate oral communication; however, intumescent material on the frame adjacent to the glass edge swells when heated in order to seal against the edge and prevent transmission of smoke or flame during a fire. Angled mirror surfaces positioned at either side and along the top of the assembly on its exterior side reflect images from positions immediately adjacent to the door and building at the sides and below the assembly, thereby permitting a person inside the door to see anyone crouching below or to one side of the viewing assembly.

A film on the inside surface of the glass limits the ability of a person outside the door to see through the viewing assembly. Additionally, alternative closures, including a hinged flap and sliding shutters, on the inside of the assembly close the view path when it is not in use and permit selective opening of the view path. The hinged flap may be provided with a sloping slot to make it possible to look through the slot when the flap is partially lifted. The inner ends of sliding shutters may be V-shaped, and one end may overlie the other so that a diamond-shaped aperture results when the shutters are partially opened.

When assembled in fire rated doors the viewing assembly 22 may be assembled without any direct heat transmitting contact between the inside and the outside, thereby reducing degradation of door fire rating which might otherwise result from installation of such a device in an opening through the door.

It is thus an object of the present invention to provide an attractive and functional security device to permit identification of and oral communication with a caller through an exterior or passage door, such as a residence, apartment, hotel room or other door, without degrading the fire rating of the door as a result of installation of the device. The disclosed structure provides a very wide angle of clear, undistorted vision in all directions (except upwards), together with the facility for oral communications through the door. The present invention does not transmit heat well from one side of the door to the other due to its sectional construction and since the inner and outer frame assemblies are separated by fire resistant materials. Other advantages of the present invention will become apparent by reference to the remainder of the disclosure, the following claims and the associated drawings.

DETAILED DESCRIPTION OF THE DRAWINGS

Figure 1:
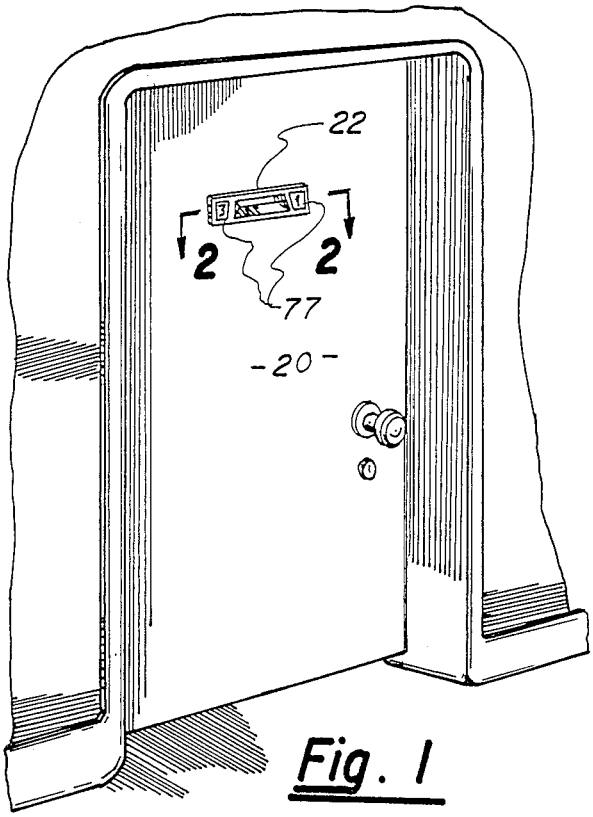
FIG. 1 is a perspective view of the outside of a typical exterior or passage door in which the viewing and oral communications assembly of the present invention is mounted.

FIG. 1 illustrates the outside of a typical exterior or passage door 20 in which the viewing and oral communications assembly 22 of the present invention is mounted at approximately adult-eye level, typically at approximately five (5) feet above floor level. As will be appreciated by reference to FIGS. 2 and 5, the assembly comprises generally a rectangular piece of glass 24 which is captured in a non-combustible frame formed by two generally U-shaped frame members 26. Frame members 26 capture glass 24 in slots 28 centered in the ends 30 of frame member 26. The slots stop short of the plate 32 which connects ends 30, thereby providing passages around glass 24 to facilitate passage of sound and thus permit oral communication through the assembly 22.

Glass 24 may be Pilkington's Georgian Wire glass, available from Pilkington Glass, Ltd., Prescot Road, St. Helens, Merseyside WAIO 3TT, England, which is self supporting at temperatures of up to 900° C., and may be coated with or bonded to a film 34 to limit transmission of light from the inside of assembly 22 to the outside. Film 34 may, for instance, be Banofix 15 film available from Banafix, Ltd., Banafix House, Amersham Road, Chesham, Bucks HP5 1NF, England.

Frame members 26 are held in a position generally centered within a rectangular opening 36 in door 20 by an outer bezel 38 and an inner bezel 40, each of which form a rectangular frame around opening 36 and extend into that opening to overlie frame members 26 adjacent to glass 24. Importantly, bezels 38 and 40 do not touch glass 24, as is particularly well illustrated in FIG. 4, which shows a space between bezel bottom 51 and glass 24 and between inner bezel side 42 and glass 24. This permits passage of sound above and below glass 24, as explained above.

Figure 2:
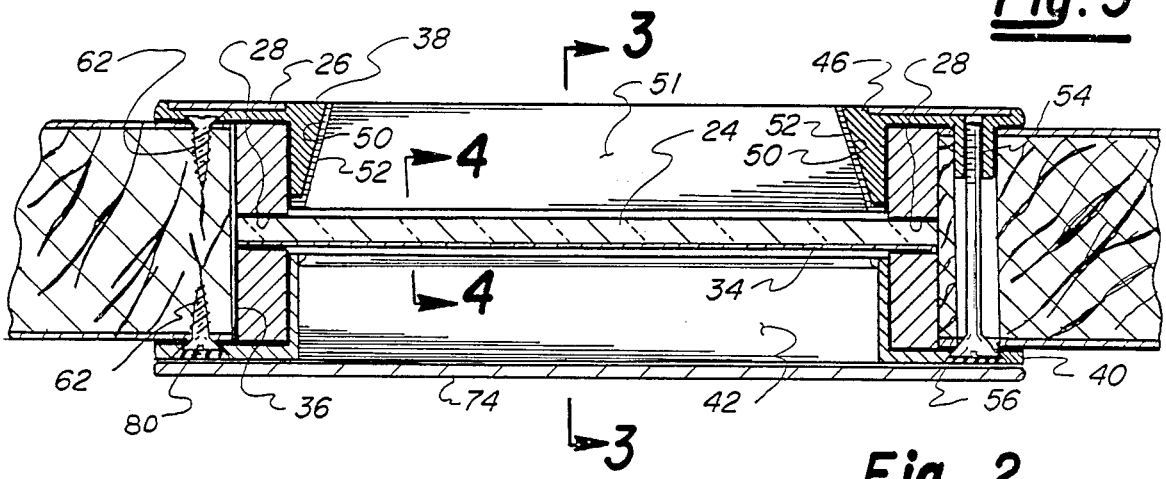
FIG. 2 is a section taken along lines 2—2 in FIG. 1 showing a horizontal cross section of the assembly of the present invention and a portion of the door in which it is mounted.
Figure 4:
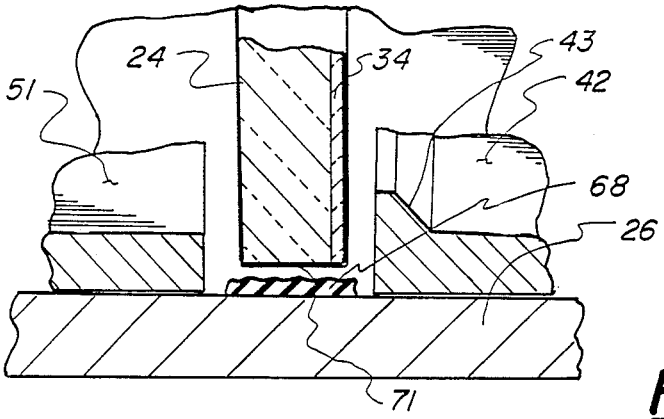
FIG. 4 is an enlarged fragmentary section taken along lines 4—4 in FIG. 2 showing the audio communication passage of the present invention.
Figure 5:
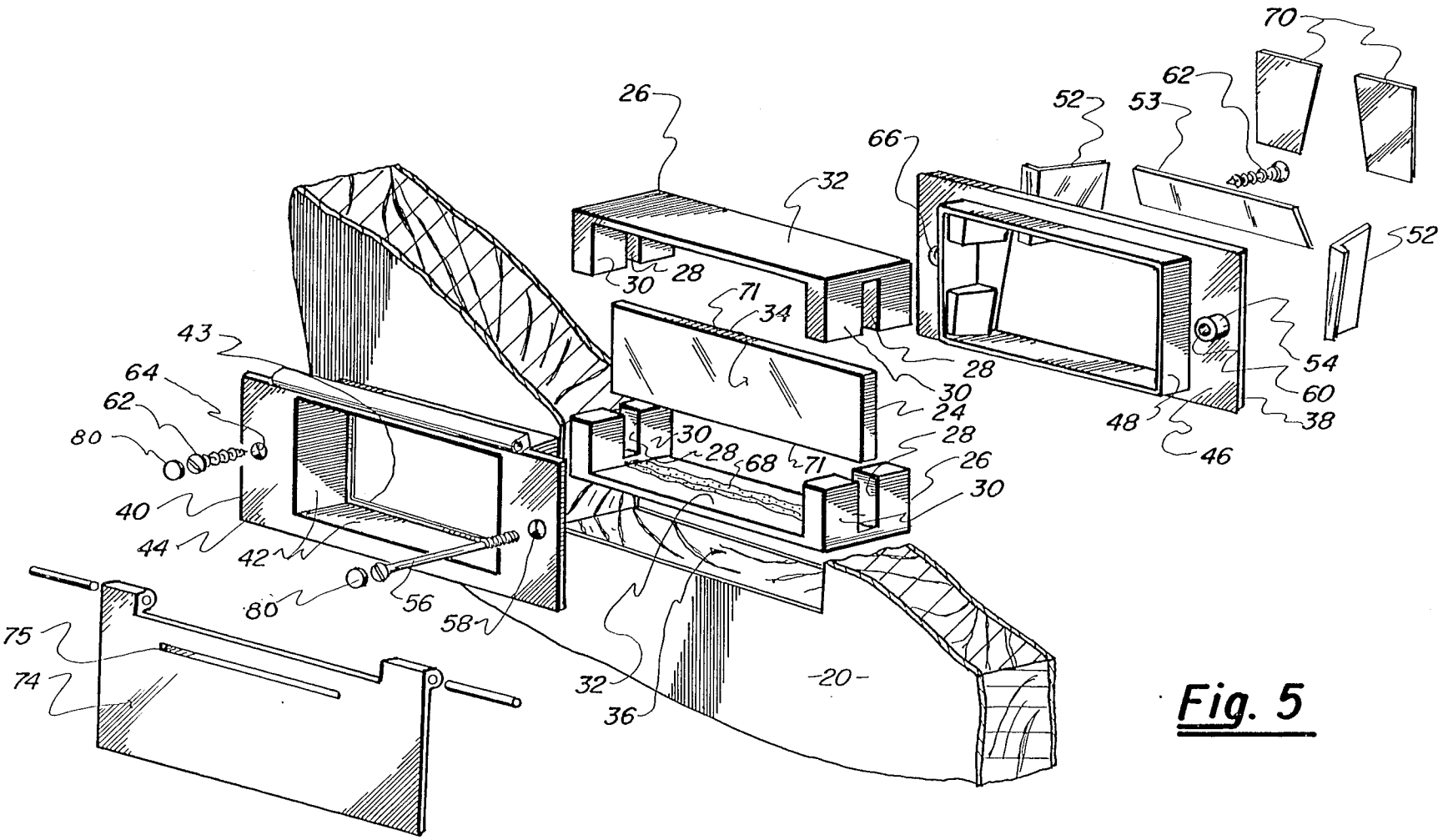
FIG. 5 is an exploded perspective view of the assembly taken from the interior side of the assembly.

As may be seen by reference to FIGS. 2 and 5, inner bezel 40 includes inwardly extending sides 42 which extend from the frame portion 44 of inner bezel 40 at substantially a right angle. As is best shown in FIG. 4, the edges of sides 42 adjacent to glass 24 may be provided with a thickened region or lip 43 in order to create a longer and more convoluted path around the edge 71 of glass 24. Such a lip 43 is intended to deflect and impede passage through viewing assembly 22 of any toxic or otherwise harmful sprays which may be directed through assembly 22 from the outside.

Outer bezel 38 includes a similar bezel frame 46 and a outer bezel box 48 which extends into door 20 opening 36 and has a generally rectangular exterior to lie against the outer margin of frame members 26. The generally vertical inside surfaces 50 of bezel box 48 form an acute angle with each of the surfaces of glass 24 and outer bezel bottom 51. A mirror 52 is mounted on each vertical surface 50. Such generally vertical mirrors 52 reflect images to a viewer inside the door 20 from areas immediately adjacent to the outside of the door 20 at the sides of assembly 22 and to some extent below it. The generally horizontal top inside surface 55 of bezel box 48 is formed by a downwardly sloping canopy portion 57 of outer bezel 38 so that top inside surface 55 also forms an acute angle with the surface of glass 24. A mirror 53 is mounted on top inside surface 55 to provide additional reflected images from the area adjacent to door 20 and immediately below viewing assembly 22.

Mirrors 52 and 53 may be provided in any number of conventional ways, as, for instance, by appropriately mounting sections of glass having either front surface or rear surface mirrors. Alternatively, highly polished metal may be used, and appropriately metalized plastic and other materials may also be used as will be readily apparent to one skilled in the art. Enlarged viewing areas may be achieved, with some concomitant distortion, by utilizing convex curved mirrors 52 and 53.

Assembly 22 may be mounted within door 20 by either of two alternative mounting methods. In an embodiment of the present invention intended for use in non-fire doors and illustrated on the right side of FIGS. 2 and 5, a machine screw 56 extends between inside bezel 40 and outer bezel 38 as is explained below. Alternatively, in a fire door embodiment of assembly 22, as illustrated on the left side of FIGS. 2 and 5, wood screws 62 separately fix inner and outer bezels 40 and 38 to door 20. In mounting the first embodiment of assembly 22 in non-fire rated doors, a machine screw 56 passes through a hole 58 in inner bezel 40 and into a threaded opening 60 in a boss 54 on outer bezel 38. While this mounting method results in no removable fasteners on the outside of door 20, the machine screw connection between inner and outer bezels 38 and 40 permits possible heat transmission between the two bezels along machine screw 56. Accordingly, the alternative mounting method, which is specifically designed for installation in fire rated doors, utilizes two wood screws 62 which pass through appropriate holes 64 and 66 in inner bezel 40 and outer bezel 38, respectively, and into the wood or other material of which door 20 is formed.

Because, as indicated above, frame 26 is made of non-combustible fiber board or other appropriate non-flammable material which does not transmit heat well, mounting of assembly 22 in accordance with the second mounting method results in an assembly which transmits very little heat from one side to the other and thereby results in minimal degradation of the fire rating of the door in which it is installed.

Figure 3:
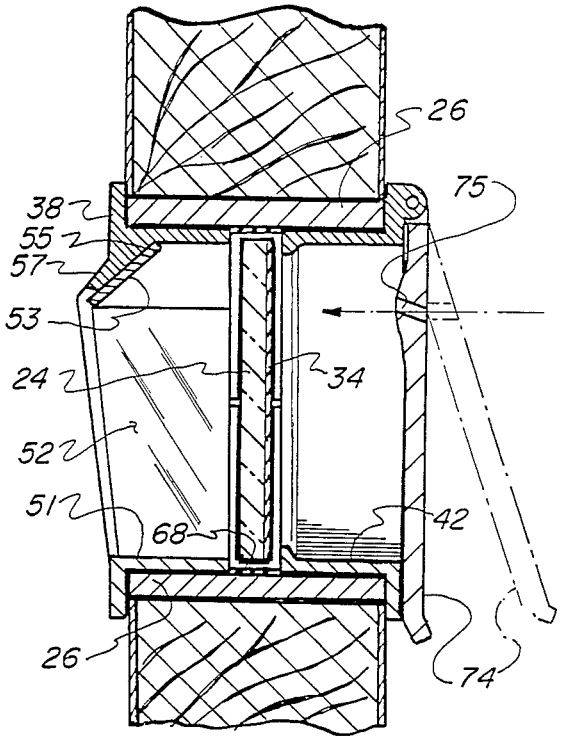
FIG. 3 is a section taken along lines 3—3 in FIG. 2.

Intumescent paint 68 shown in FIGS. 3, 4 and 5 is applied to frame member 26 plates 32 adjacent to the longer edges 71 of glass 24. Such intumescent material 68 reacts to heat by swelling, thereby sealing between frame members 26 and adjacent edges 71 of glass 24 to prevent smoke and/or flame from passing through assembly 22 in the event of fire adjacent to either side of assembly 22. Suitable intumescent material may be Lorient LC0001 available from Lorient Poly Products, Ltd., Fairfax Road, Heathfield Industrial Estate, Newton Abbot, Devon, England.

The heads of screws 62 are covered by coverplates 70 which may be glued in place or held by a wide variety of other appropriate means, such as pins protruding from the plates which engage openings in the bezel 38 and cannot be disengaged without damaging the plates 70, thus providing security by making it difficult to access the screws necessary to remove the outer bezel 38. Other methods of assembly include decorative brads or rivets, tamper-resistant screws, and use of a pheripheral lip on the bezel 38 to capture the edge of plates 70 which would snap into place by being forced beyond the lip.

Cover plates 70 may carry room numbers 77 (shown in FIGS. 1 and 8) or other identifying information. This may also be accomplished by substituting an outer bezel cover 79 (FIG. 8) for plates 70. Such a bezel cover 79 may be generally rectangular in shape with an opening 72 so that the cover 79 can overlie outer bezel 38 or a portion of outer bezel 38 and provide surfaces 73 adjacent to the sight path through viewing assembly 22 to carry room numbers 77 names or other identifying information. If desired, such a bezel cover 79 may be locked in place by bezel 38 when bezel 38 is mounted on the door 20 or may be fastened to assembly 22 by any other means desired, including the methods described above for fixing coverplates 70 to bezel 38.

The heads of screws 56 and 62 on inner bezel 40 are covered by disc 80 which may be glued or held by other appropirate means thus providing security by making it difficult to access the screws necessary to remove the inner bezel 40.

A closure may be desirable on the inside of assembly 22 to obstruct the sight and audio path provided by assembly 22. Two alternative such closures are illustrated in FIGS. 2, 3, 5, 6 and 7. FIGS. 2, 3 and 5 illustrate a hinged flap closure 74 which is a rectangular flap substantially equal in size to the face of inner bezel 40. Flap 74 is hinged along its top edge so that it may be lifted to look and speak through assembly 22 and when released will fall closed to overlie inner bezel 40. Flap 74 contains a narrow horizontal slot 75 which passes through flap 74 at an angle sloping up from the outside to inside of flap 74. Consequently, it is not possible to see through the slot 75 when flap 74 is fully closed, but when flap 74 is raised slightly, it is possible to see through slot 75 before flap 74 is raised to its fully open position. A decorative cover or finish on flap 74 may coordinate with room finish to enhance the appearance of assembly 22 or make it less obtrusive.

Figure 6:
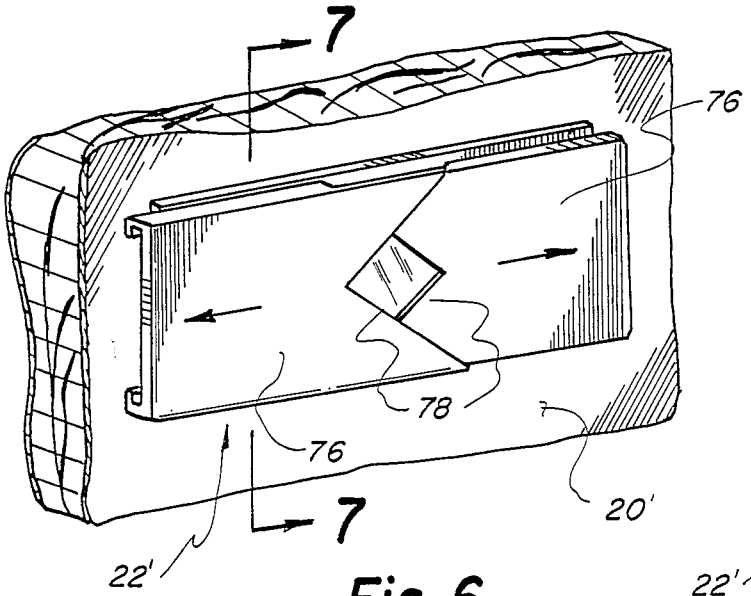
FIG. 6 is a perspective view of the inner side of an alternative embodiment of the present invention having sliding covers.
Figure 7:
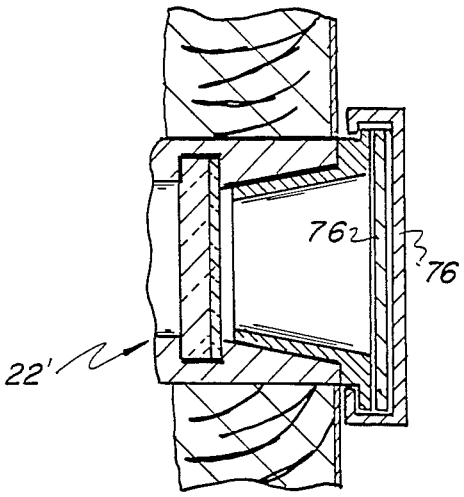
FIG. 7 is a fragmentary section taken along lines 7—7 in FIG. 6.
Figure 1:
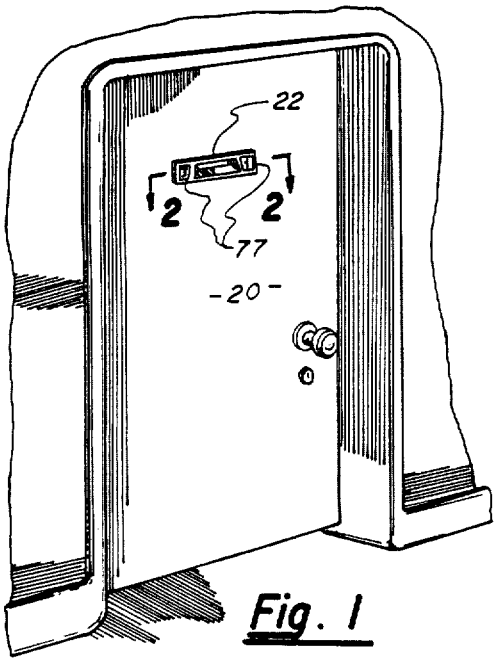
Figure 3:
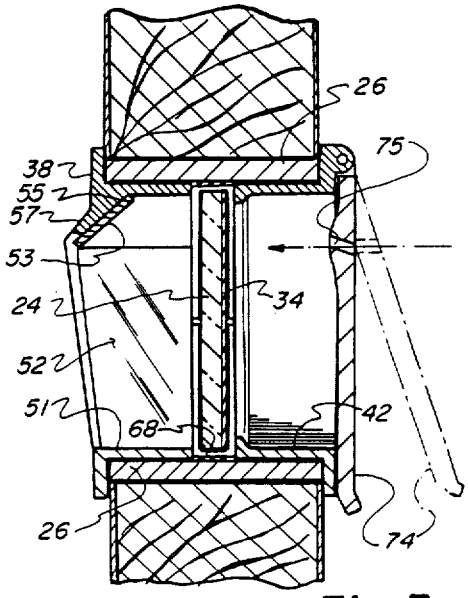
Figure 2:
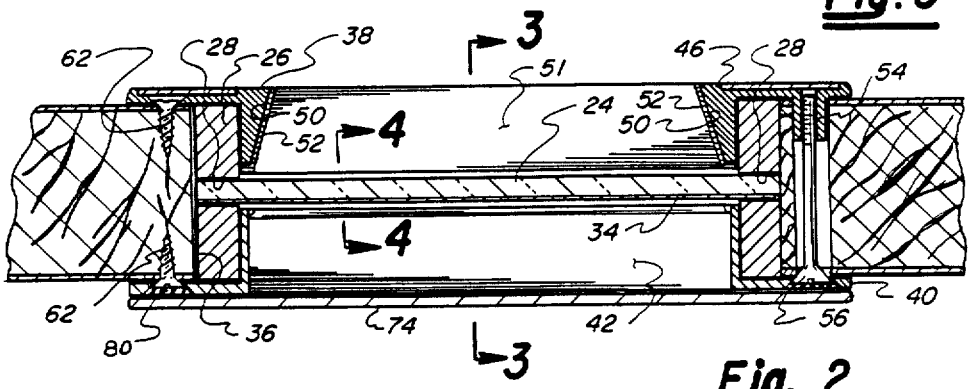
Figure 4:
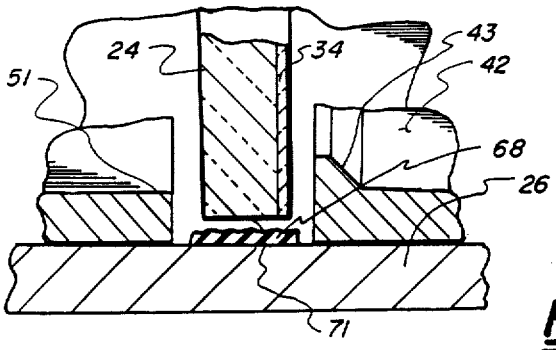
Figure 5:
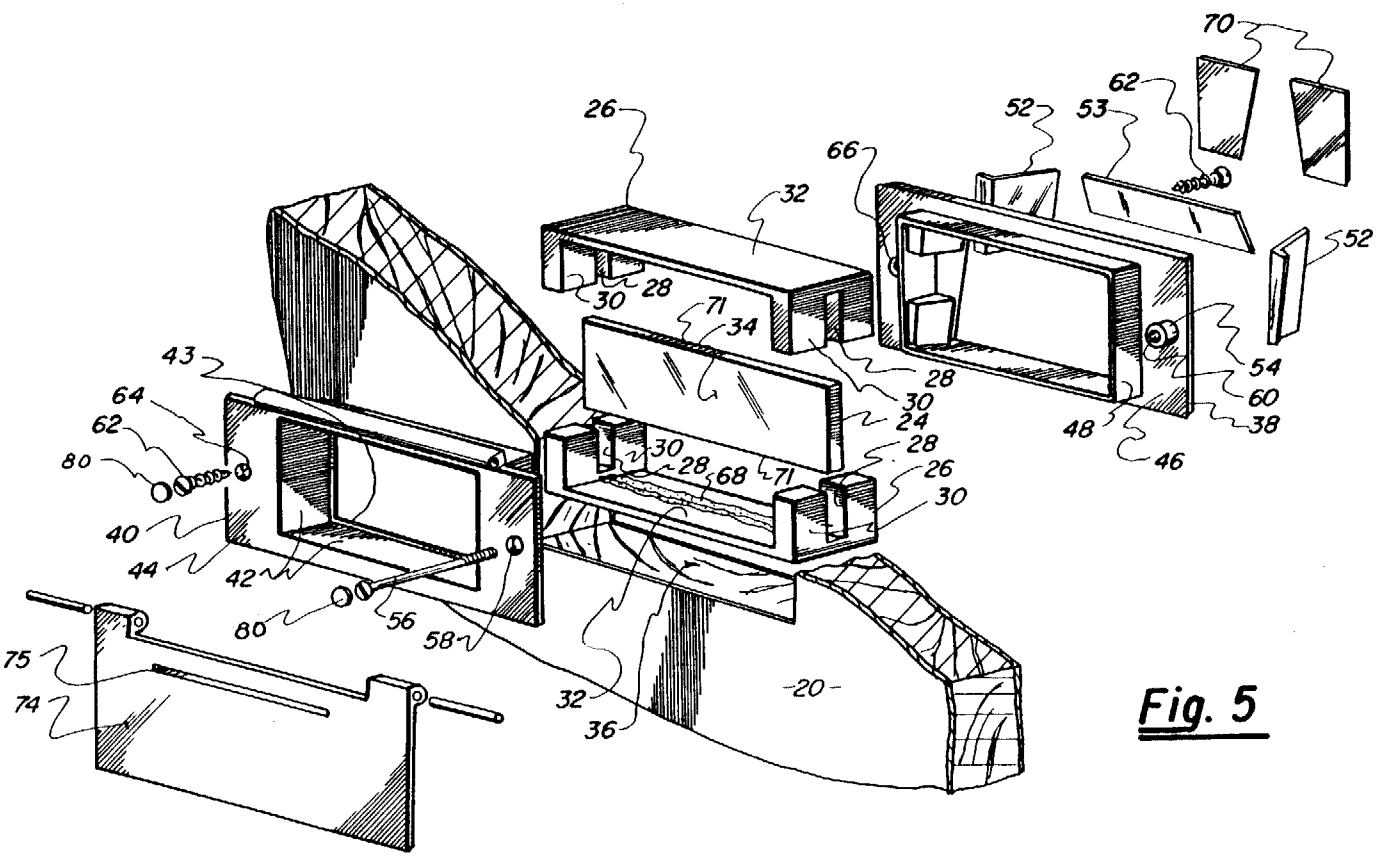
Figure 8:
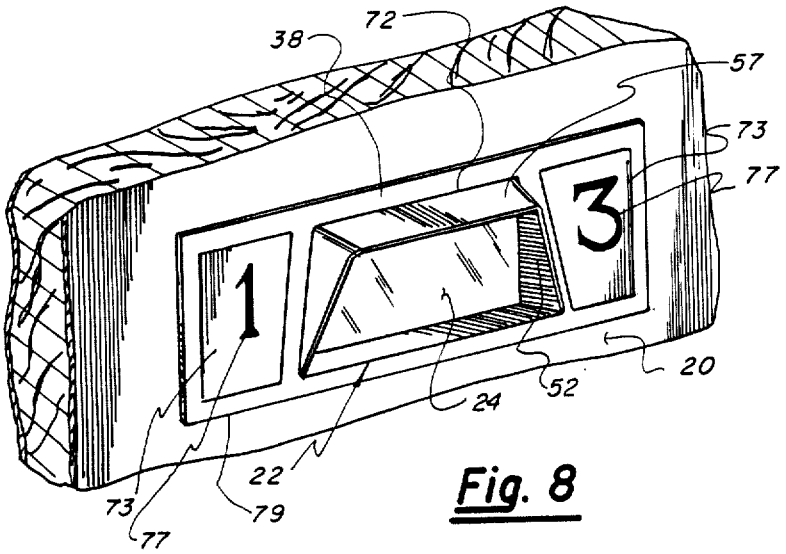
Figure 6:
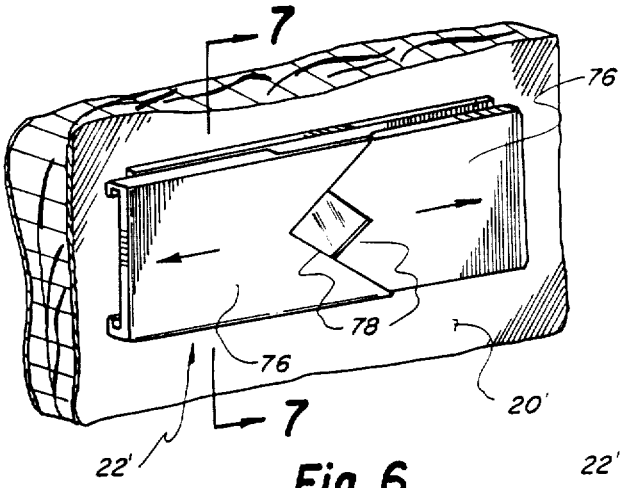
Figure 7:
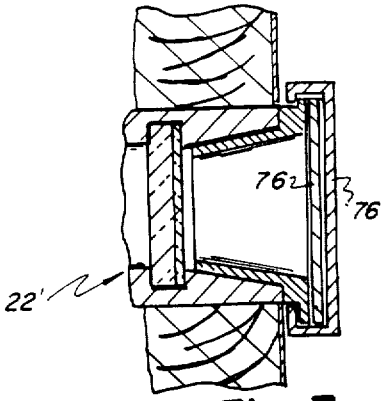

An alternative closure is illustrated in FIGS. 6 and 7 on an alternative embodiment of the present invention, viewing assembly 22'. This closure is provided by one or more horizontally sliding shutters 76. Two such shutters 76 are illustrated in FIG. 6 with V-shaped ends 78, one of which overlies the other when shutters 76 are closed, thereby fully occluding the sight path in assembly 22'. Partial opening of shutters 76 results in a small peephole, and further movement of shutters 76 fully clears the sight and audio path of assembly 22'.

The foregoing description of the present invention is for purposes of explanation and illustration. It will be apparent to those skilled in the relevant art that modifications and changes may be made to the invention as thus described without departing from its scope and spirit.

I claim:

1. A viewing assembly for a door comprising a piece of glass captured between inner and outer bezels and at least one mirror on the outer bezel for reflecting images through the glass from positions on the outer bezel side of the assembly.

2. The viewing assembly of claim 1, further comprising two mirror surfaces oriented generally vertically on either side of the viewing assembly and at an acute angle to the surface of the glass.

3. The viewing assembly of claim 2, further comprising a third mirror surface oriented generally horizontally along the top of the viewing assembly and at an acute angle to the surface of the glass.

4. A viewing assembly in accordance with claim 2, wherein said mirror surfaces are convex.

5. The viewing assembly of claim 1, further comprising a frame of non-combustible material surrounding the edge of the glass.

6. A viewing assembly in accordance with claim 5, wherein said frame does not make continuous contact with the edge of the glass, thereby providing a audio path from one side of the glass to the other.

7. A viewing assembly in accordance with claim 6 further comprising intumescent material in the proximity of the audio path.

8. The viewing assembly of claim 7, further comprising a closure attached to the inner bezel for selectively occluding the sight path through the glass.

9. A viewing assembly in accordance with claim 8, wherein said closure is a hinged flap.

10. A viewing assembly in accordance with claim 9, wherein said hinged flap contains a slot.

11. A viewing assembly in accordance with claim 8, wherein the closure is a two-part shutter with V-shaped ends, one of which overlies the other when the shutter is closed and which together define a diamond-shaped aperture when the shutter is partially open.

12. The assembly in accordance with claim 7, further comprising a means for independently affixing the bezels to the door, thereby avoiding an efficient heat transmission path from one bezel to the other.

13. A viewing and oral communications assembly for a door comprising:

a. a rectangular section of glass;

b. a frame for holding the glass, which frame is made of non-combustible material which is a poor conductor of heat and which does not contact the glass around its entire periphery;

c. intumescent material adjacent to portions of the glass periphery which are not in contact with the frame;

d. inner and outer bezels which capture the frame and hold it within an opening through the door when the assembly is mounted in the door;

e. at least one mirror positioned to transmit images through the glass from an area adjacent to the door;

f. a film on the glass to limit transmission of light through the glass; and g. a closure for the assembly mounted on the inside bezel.

14. A viewing and oral communications assembly in accordance with claim 13, further comprising:

h. an identification plate mounted on the outer bezel.

* * * * *

UNITED STATES PATENT AND TRADEMARK OFFICE

CERTIFICATE OF CORRECTION

PATENT NO. : 4,763,444

DATED : August 16, 1988

INVENTOR(S) : Ruben R. Ritchie

It is certified that error appears in the above-identified patent and that said Letters Patent is hereby corrected as shown below:

In the Specification

At column 3, line 28 replace "Banofix" with --Banafix--.

At column 4, lines 63-64 replace the hyphenated word "pheripheral" with --peripheral--.

In the Claims

At column 6, line 14 replace "a" with --an--.

In the Drawings

In FIG. 3, lengthen the lead line associated with the numeral 26 so that it terminates at a frame member as described in the application.

In FIG. 4, lengthen the lead line associated with the numeral 51 so that it terminates at the bottom of the outer bezel as described in the application.

Figure 8:
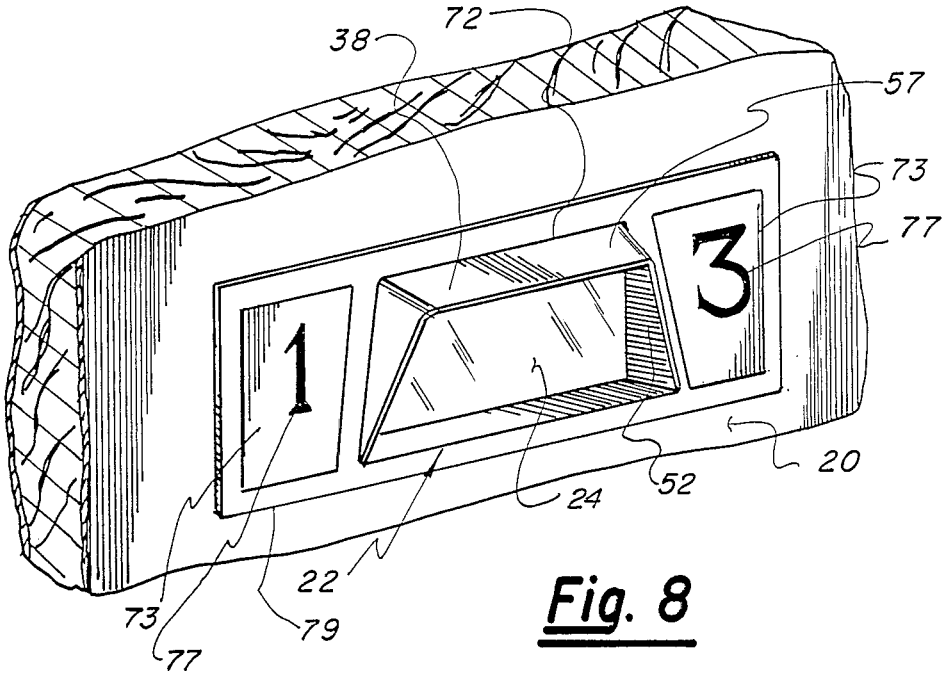
FIG. 8 is a perspective view of the outer side of a viewing assembly of the present invention having a bezel cover with room numbers.

In FIG. 8, shorten the lead line associated with the numeral 38 so that it terminates at the outer bezel as described in the application.

UNITED STATES PATENT AND TRADEMARK OFFICE

CERTIFICATE OF CORRECTION

PATENT NO. : 4,763,444

DATED : August 16, 1988

INVENTOR(S) : Ruben R. Ritchie

It is certified that error appears in the above-identified patent and that said Letters Patent is hereby corrected as shown below:

FIGS. 1 - 8 should appear as shown on the attached sheets.

Signed and Sealed this

Thirteenth Day of November, 1990

*Attest:*

HARRY F. MANBECK, JR.

*Attesting Officer*

*Commissioner of Patents and Trademarks*